US005216899A

United States Patent [19]

Fabris

[11] Patent Number: 5,216,899

[45] Date of Patent: Jun. 8, 1993

[54] ROTATING SINGLE CYCLE TWO-PHASE THERMALLY ACTIVATED HEAT PUMP

[76] Inventor: Gracio Fabris, 2039 Dublin Dr., Glendale, Calif. 91206

[21] Appl. No.: 621,047

[22] Filed: Nov. 29, 1990

[51] Int. Cl.[5] ..... F25B 13/00; F24F 3/14

[52] U.S. Cl. ..... 62/324.6; 62/324.1; 62/500

[58] Field of Search ..... 62/324.1, 324.6, 236, 62/498, 500, 512

[56] References Cited

U.S. PATENT DOCUMENTS

| | | | |
|---|---|---|---|
| 3,799,243 | 3/1974 | Castillo | 62/324 |
| 4,202,493 | 5/1980 | Franchina | 62/324.1 |
| 4,438,638 | 3/1984 | Hays et al. | 62/500 |
| 4,475,360 | 10/1984 | Suefuji et al. | 62/324.1 |
| 4,576,006 | 3/1986 | Yamaoka | 60/641.5 |
| 4,774,816 | 10/1988 | Uchikawa et al. | 62/324.1 |

*Primary Examiner*—Henry A. Bennet

*Assistant Examiner*—William C. Doerrler

*Attorney, Agent, or Firm*—John D. McConaghy

[57] ABSTRACT

A single fluid two-phase flow thermally activated heat pump is made to operate efficiently by incorporating rotating energy conversion components, principally a two-phase flow turbine. An efficient two-phase flow reaction turbine which powers a vapor compressor and a liquid pump is employed. The two-phase turbine extracts power from expanding two-phase flow which achieves low velocities. A rotating vapor compressor is positioned downstream of the turbine. The thermodynamic cycle is modified by utilizing full evaporation of the two-phase flow such that only dry vapor is pressurized in the compressor. The system is simpler and more efficient than most thermally activated heat pumps due to the integration of power producing and heat pumping thermodynamic cycles. The heat pump is contemplated for such applications as air conditioning, cooling, heating and industrial heat pumps.

16 Claims, 4 Drawing Sheets

ROTATING SINGLE CYCLE TWO-PHASE THERMALLY ACTIVATED HEAT PUMP

BACKGROUND OF THE INVENTION

The present invention is directed to a thermally activated (powered by heat) heat pump. The heat pump is of an integrated type with a single cycle and a single working fluid which flows undivided in series through a thermal engine driving portion and then through a heat pump portion.

There are many terrestrial and space applications where replacement of electrically activated heat pumps by thermally activated heat pumps would result in major savings in energy and cost. An example of such a use is air conditioning units for houses and buildings. If efficient thermally activated heat pumps can be developed, then most of such air conditioning units could be powered by natural gas with large savings. The use of thermally activated heat pumps is of sufficient importance that the United States Department of Energy supports a significant research and development program on such devices. However, all presently supported projects employ separate heat pumping and mechanical power supplying units, for example, internal combustion engines based on the Stirling, Brayton or Rankine cycles driving heat pumping units.

When heat pumps are used for heating purposes, those that are thermally activated could provide significantly more heat than the heating value of fuel used to power the heat pump. This potentially could be achieved without expenditure of electrical energy. This means, for example, if gas or other fuel is used to heat a building, by utilizing a thermally activated heat pump substantially more heat (heating value) could be provided to the building. The main thermodynamic reason behind this is that fuel can burn at considerably higher temperature than needed for heating. Insertion of a thermally activated heat pump decreases thermodynamic irreversibilities and improves utilization of fuel several fold.

U.S. Pat. No. 3,621,667 to Castillo has proposed a slight modification over the usual thermally activated heat pump in which a thermal engine, a Rankine cycle vapor turbine, drives a vapor compressor cycle heat pump. In the Castillo patent, the only innovation is that the vapor exiting the turbine cycle and the vapor exiting the compressor cycle are then combined and condensed in a single common condenser. The system suffers from the usual problems of a Rankine cycle. These problems are the need to superheat the vapor before it enters the vapor turbine, inability of the vapor turbine to handle moist vapor, existence of pinch points and poor matching of heat exchange curves of a heat source fluid and of the vapor, resulting in lower thermal efficiency.

U.S. Pat. No. 4,438,638 to Hays et al discloses the modification of a conventional electrically or mechanically driven heat pump. A throttling pressure let-down expander for a condensate (liquid) is replaced by DeLaval stationary two-phase nozzles. In the nozzles, saturated condensate flashes into low quality two-phase flow. In this way, most of the enthalpy drop in the pressure let-down expansion is converted into kinetic energy of two-phase flow (a major part of it being in the liquid phase). A good part of the kinetic energy of the liquid is converted into useful mechanical energy in reaction hydraulic turbine rotor. That is, only the stationary nozzle experiences two-phase flow while only the liquid passes through the turbine rotor. In practice, this stationary two-phase nozzle/hydraulic turbine rotor combination has proven to have a turbine efficiency of up to only 43%. Energy savings predicted by the inventors is only about 5%. This is due to the fact that low available enthalpy drop is usually encountered when flashing saturated liquid between two low, heat absorption and heat rejection pressures. Since the efficiency of the stationary two-phase nozzle/hydraulic turbine combination turned out to be lower than predicted by Hays et al., actual energy savings with this system is lower than 5%.

U.S. Pat. No. 1,275,504 to Vuilleumier discloses a thermally activated integrated heat pump which is supposed to use a single fluid flowing as a single stream consecutively through a thermal engine driving cycle and a heat pumping cycle. There has been considerable research and development on this system during the last 15 years. No continuous flow (steady state) embodiment using this cycle has been achieved to date. The system is quite complicated with two reciprocating pistons connected by an involved mechanism and four recuperative and two regenerative heat exchangers in which flow is injected intermittently. In practice, the efficiency of these systems has not appreciably approached its ideal lossless theoretical value. Nevertheless, the concept is still promising as recent activity indicates.

U.S. Pat. No. 3,621,667 to Mokadam discloses another thermally activated continuous flow integrated heat pump concept. The concept is shown schematically on FIG. 1 with its thermodynamic P-v and T-s diagrams given in FIGS. 2 and 3. In this cycle, a thermodynamic working fluid is first heated as a high pressure liquid to its saturation temperature in heater 1 by addition of high temperature heat $Q_{in\ f}$. The working fluid is then flashed through a stationary two-phase flow DeLaval (converging-diverging) nozzle 2 achieving the lowest temperature D. Subsequently, the working fluid is separated in a separator 3, with most of the liquid in the two-phase stream being evaporated by addition of low temperature heat $Q_{in\ e}$ in an evaporator 4. Next, the two-phase flow is decelerated in an expanding diffuser 5 which converts kinetic energy of the fluid into an increased pressure (and increased temperature) state F. Condensation is accomplished in a condenser 6 by a rejection of heat $Q_{out\ c}$. The condensed liquid is pumped to a higher pressure by a pump 7. Subcooled liquid then enters the heater 1 completing the cycle. It is understood that a prototype of this device has never been built. If this system could be made to work as successfully as the first order thermodynamic analysis indicates, it certainly would be a very useful device with many applications. It would be considerably simpler and more reliable than other thermally activated heat pumps presently being developed. In addition, it would be more efficient. However, more detailed fluid dynamic analysis indicates that there would be problems with designing and operating an efficient two-phase diffuser (process E-F on FIGS. 1, 2, 3) which will cause a failure of the whole cycle. It is known that two-phase flow diffusers are inherently inefficient in practice. Namely, most or an appreciable part of the kinetic energy at the entrance to a diffuser is carried by the liquid phase. In practice, this liquid phase does not get appreciably slowed down while passing through a diffuser. In this way, most of the kinetic energy of the liquid is not recovered but is uselessly dissipated. If the liquid is separated out upstream of the diffuser, as indicated in FIG. 1, then the diffuser will be equally dissipated through friction with the wall. Since the pressure and enthalpy drops across the stationery two-phase nozzle are high, achieved velocities would also be very high. The high velocities would cause high losses in the nozzle as well.

SUMMARY OF THE INVENTION

It is a primary object of the present invention to provide a system and method for providing thermal cooling or heating.

Another object of the present invention is to provide a thermally activated heat pump without need for appreciable mechanical or electrical energy input.

Yet another object of the present invention is to provide a simple heat pump with a single thermodynamic cycle on a single working fluid which flows through all components of the system as a single stream.

These and other objects of the present invention are achieved by having a system where the condensed liquid is pumped to a higher pressure by a pump (which could be of a rotating type). Subsequently, the liquid is heated to its highest temperature saturation point by burning of fuel. Subsequently, it is flashed (pressure let-down expansion) to a low temperature and pressure through a two-phase turbine rotor. Expanding two-phase flow transforms most of its energy into available mechanical work of the turbine shaft. Subsequently, the low temperature two-phase flow discharging from the turbine is evaporated by addition of low temperature heat (in this way the cooling function is accomplished). Subsequently, the dry low temperature vapor is compressed to a higher temperature and pressure by a compressor (which could be of a rotating type). Subsequently, higher temperature and pressure vapor is condensed fully by rejection of heat (in this way the heating function is accomplished). Subsequently, condensed liquid is recirculated by the above-mentioned pump. The pump and the vapor compressor could be powered by the above-mentioned two-phase turbine rotor.

BRIEF DESCRIPTION OF THE DRAWINGS

A more complete appreciation of the invention and its advantages will be understood by reference to the following drawings.

DETAILED DESCRIPTION OF THE PREFERRED EMBODIMENTS

Figure 1:
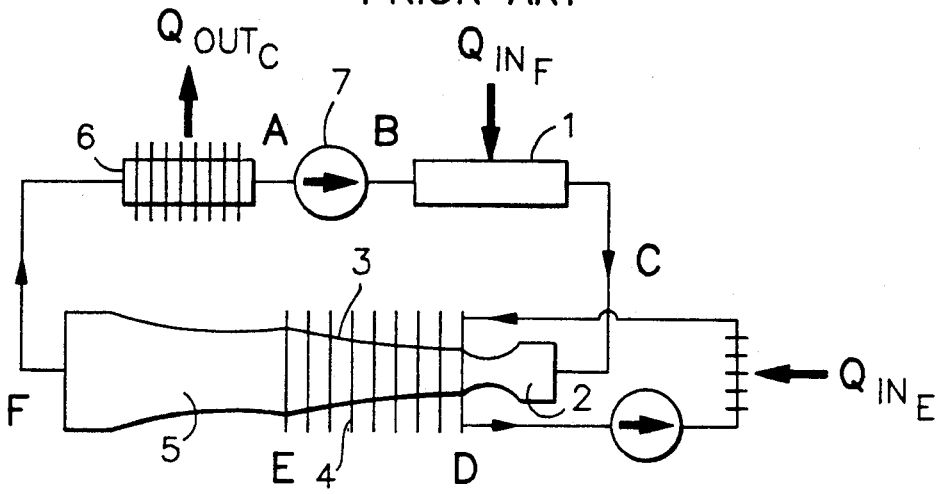
FIG. 1 PRIOR ART
FIG. 1 is a schematic of a prior art stationary single cycle two-phase thermally activated heat pump.
Figure 2:
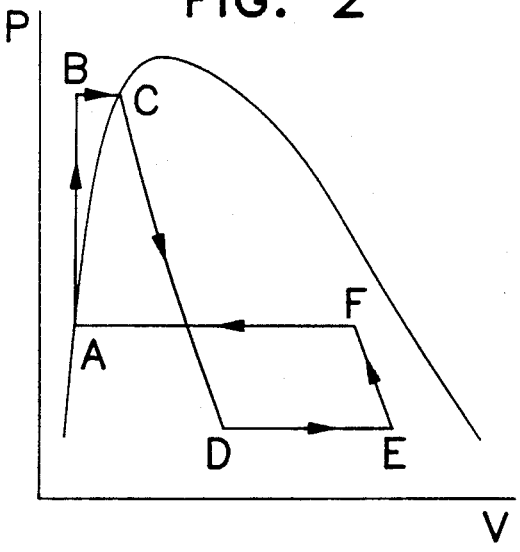
FIG. 2 is a P-v diagram for the prior art device of FIG. 1.
Figure 3:
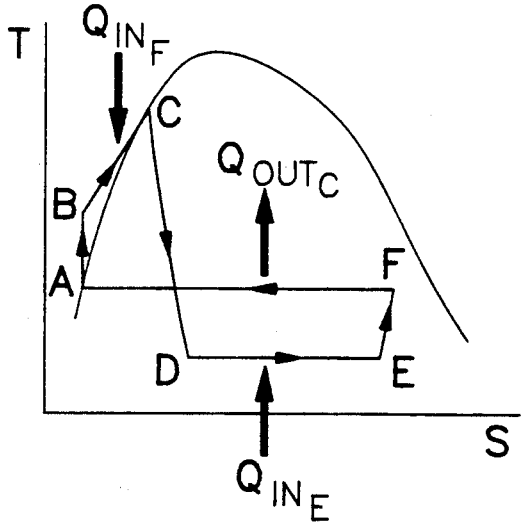
FIG. 3 is a T-s diagram for the prior art device of FIG. 1.
Figure 4A:
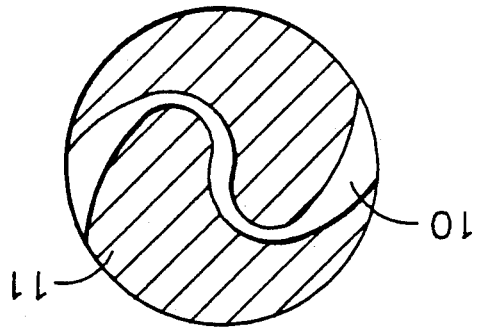
FIG. 4A is a cross section taken along line 4A—4A of FIG. 4.
Figure 4:
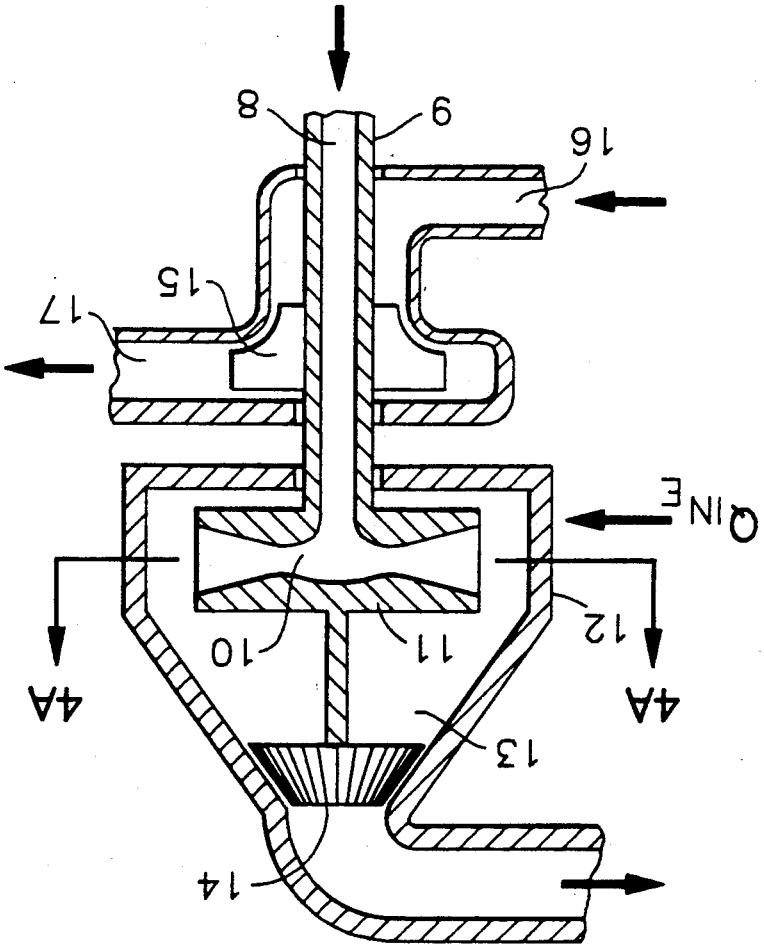
FIG. 4 is a two-phase turbine, compressor and pump assembly illustrated in cross section.
Figure 5:
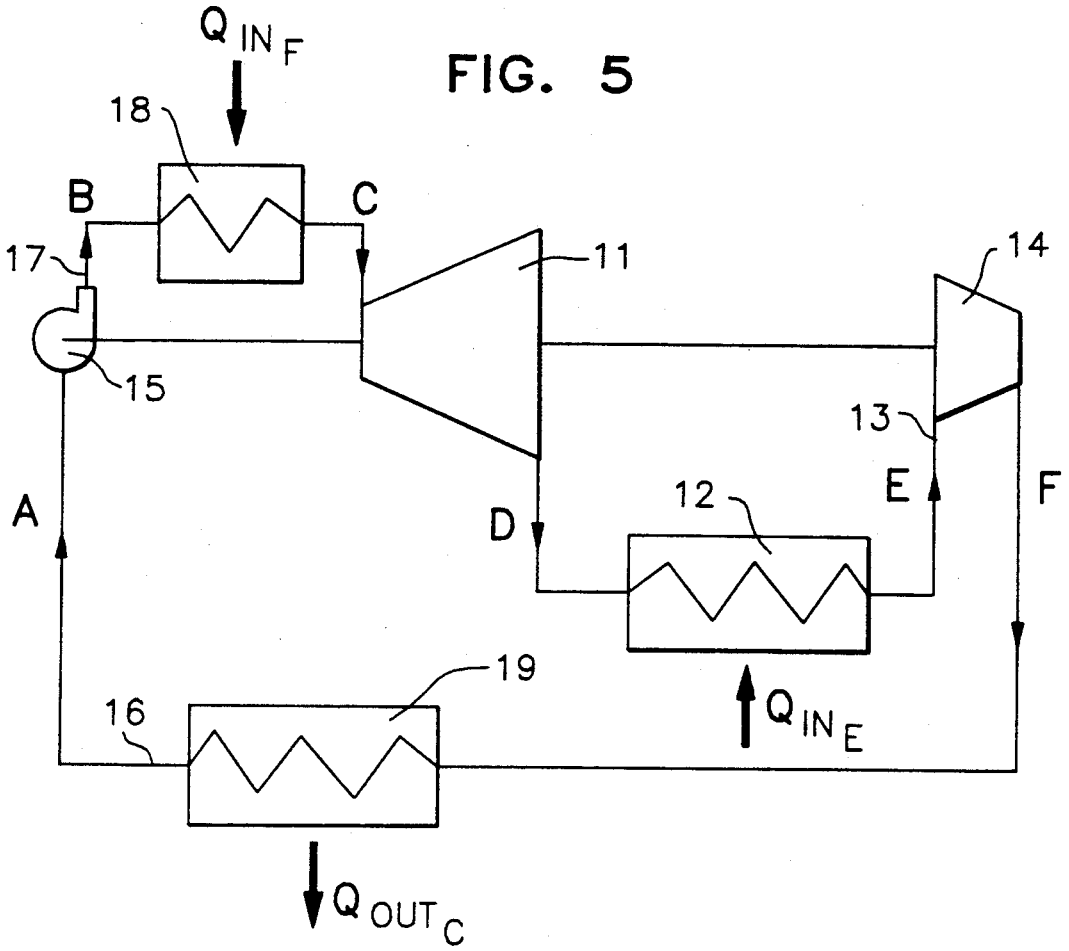
FIG. 5 is a schematic diagram of a single cycle two-phase thermally activated heat pump.

One possible basic cycle arrangement of the rotating mechanical parts of the preferred embodiment are shown in FIG. 4. FIG. 5 is a schematic block diagram of the system described employing the device of FIG. 4.

Figure 6:
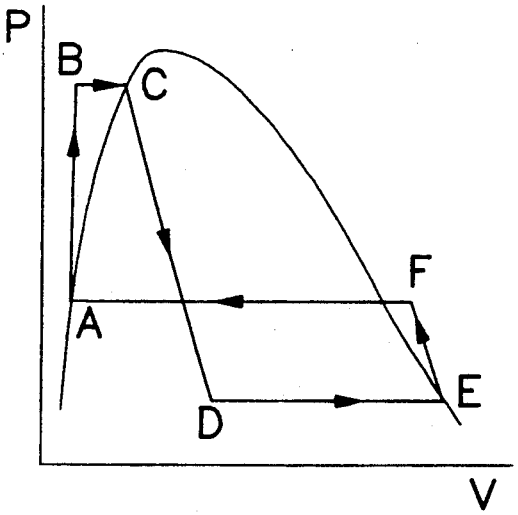
FIG. 6 is a P-v diagram for the device of FIG. 5.
Figure 7:
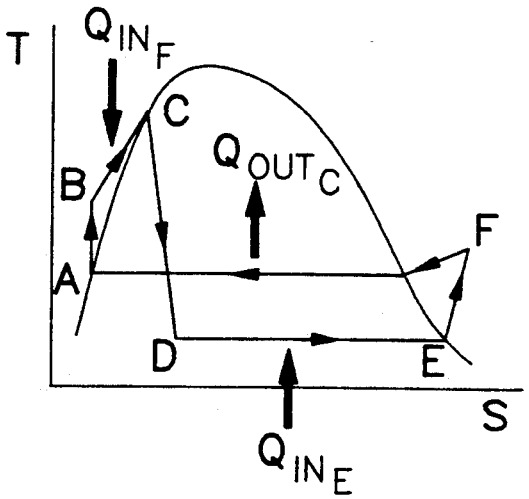
FIG. 7 is a T-s diagram for the device of FIG. 5.

FIGS. 6 and 7 are thermodynamic P-v and T-s diagrams describing operation of the embodiment. Various standard elements are not shown or are not shown in detail because they are individually well known in the prior art. Standard elements employed in the present invention include heat exchangers, a fuel combustor, control devices, valves and a start-up electrical motor.

Steady state operation of the embodiment can be described as follows. Condensed working fluid 16 at state A is pumped by a liquid pump 15 to an increased pressure, state B. High pressure liquid at state B enters a heat exchanger (combustor or heater) 18 in which heat $Q_{in\,f}$ is added from a combusting fuel. In this way, the liquid is brought to its highest pressure and temperature state C.

The liquid 8 at thermodynamic state C enters a two-phase flow turbine 11. The two-phase turbine 11 could be of the reaction type as shown in FIG. 4, containing curved DeLaval (converging-diverging) nozzles. The fluid transfers most of its energy as work to the turbine reaction rotating nozzles. The liquid 8 could enter the turbine through a hollow shaft 9 as seen in FIG. 4.

At the discharge of the turbine 11, the two-phase fluid flow is at the lowest temperature and pressure, in state D. This fluid in state D enters a heat exchanger 12 which could be embodied as the stationary housing 12 of the turbine 11. The discharging liquid part of the fluid in state D, due to its tangential velocity and higher density compared to the vapor, will adhere to the housing 12. Low temperature heat $Q_{in\,e}$ added to the liquid through the housing 12 evaporates the liquid until all two-phase fluid becomes dry vapor 13 of thermodynamic state E.

The dry vapor 13 enters a compressor 14. The compressor 14 is powered by a two-phase turbine 11 which also powers the liquid pump 15. The compressor 14, the turbine 11 and the liquid pump 15 could be mounted on the same shaft 9 as shown in FIG. 4. The compressor 14 raises pressure of the vapor 13 from the state E to a state F which is at a intermediate pressure.

The vapor then enters a heat exchanger 19 where the vapor is cooled and condensed at constant pressure from the state F to a liquid 16 of state A by rejecting heat $Q_{out\,c}$. The liquid 16 enters the pump 15, thus completing the cycle.

The liquid pump 15, the two-phase turbine 11 and the vapor compressor 14 could be assembled on the same shaft as shown in FIG. 4. The complete thermodynamic cycle is such that mechanical power generated in the two-phase turbine 11 is more than sufficient to drive the liquid pump 15 and the vapor compressor 14 during steady state as well as for start-up operations.

Figure 9:
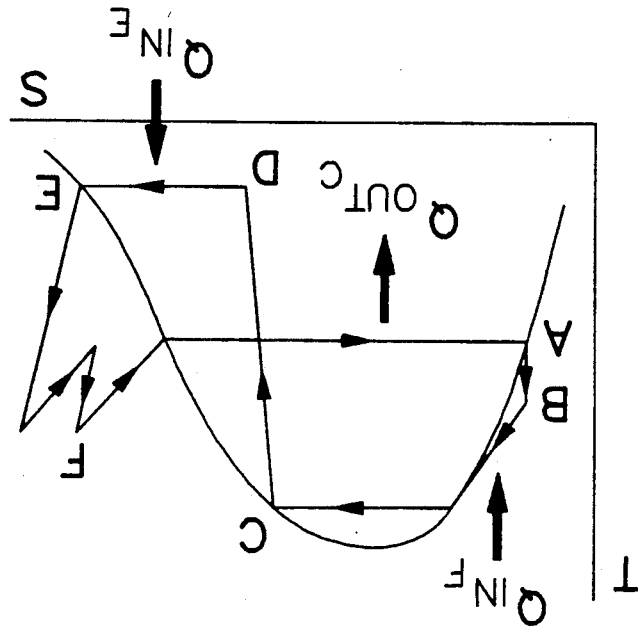
FIG. 9 is a T-s diagram for a single cycle two-phase thermally activated heat pump with dry vapor at the turbine entrance and a compressor with an inner cooling stage.

As may be necessary, different modifications of the basic cycle can be made. For example, it could prove advantageous for some applications to heat the liquid beyond the saturation liquid line into the two-phase region or even into the dry steam region. The T-s diagram for two such modified cycles are given in FIGS. 8 and 9. For the case in FIG. 8, the working fluid is in the two-phase regime at the entrance to the two-phase flow reaction turbine. In FIG. 9 at the same location, the fluid is a dry vapor. However, during the expansion in the rotor, two-phase flow develops.

Figure 8:
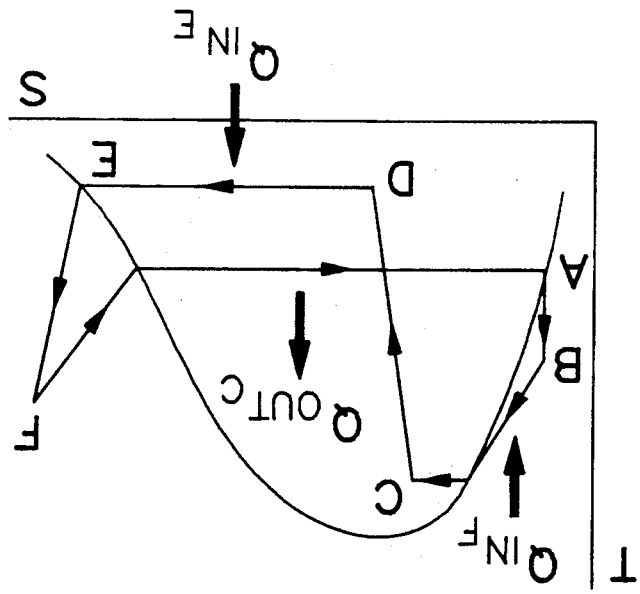
FIG. 8 is a T-s diagram for a single cycle two-phase thermally activated heat pump with two-phase flow at the turbine entrance.

The flow pattern inside the curved two-phase rotating nozzles would be in the form of a spray flow for both cases in FIGS. 8 and 9. It is known that nozzles with such flow patterns could be made to be very efficient. Since properly curved reaction nozzles are used with no separation, there will not be appreciable erosion of the rotor such as occurs when high velocity two-phase spray flow impinges on turbine blades in conventional action axial flow steam turbines.

It is also possible to modify the system shown in FIG. 8 in such a way that liquid and vapor are separated before entering the turbine and then are expanded through separate rotating nozzles. FIG. 9 indicates use of a compressor with inner cooling (prior art) that increases efficiency. In practice, considerable beneficial effect of the inner cooling can be achieved just by cooling the outside housing of the compressor.

EXAMPLE

If the working fluid is water, the following table gives the thermodynamic states:

| STATE | PRESSURE [PSIA] | TEMPERATURE [°F.] | QUALITY [%] | ENTHALPY [BTU/LB°R] |
|---|---|---|---|---|
| A | 2.892 | 140 | 0 | 107.96 |
| B | 3.000 | 600 | 0 | 108.00 |
| C | 1541.0 | 600 | 0 | 616.7 |
| D | 0.9503 | 100 | 36 | 441.0 |
| E | 0.9503 | 100 | 100 | 1107.0 |
| F | 2.892 | 265 | 100 | 1180 |

It is apparent in this example that isentropic available enthalpy drop in the two-phase turbine is $h_{TRB}=h_c-h_D=174.3$ BTU/lb °F. while required ideal (isentropic) compressor work is $h_{comp}=h_F-h_E=73$ BTU/lb °F.

If the turbine efficiency is 75% then turbine shaft work of 130.725 BTU/lb °F. will be actually available to drive the compressor. This means that the compressor efficiency should be better than 55.8% which is easily achievable. Should more power be needed, such as for a higher degree of cooling, the temperature or quality of thermodynamic state C should be increased appropriately.

I claim:

1. A thermally activated heat pump which utilizes single working fluid which as a whole passes consecutively through all parts of the apparatus in a closed loop series; the working fluid in low temperature saturated liquid state at condensation pressure is pumped to higher pressure with a pump; subsequently heat is added to said liquid of increased pressure, said liquid via said heating is brought to a high temperature saturated liquid state; said high temperature liquid passes and flashes subsequently in form of two-phase flow through a rotating two-phase flow turbine; in such a way said working fluid performs work on said two-phase turbine which in turn powers said liquid pump and a lower compressor; two-phase flow exiting said two-phase turbine separated by impinging tangentially on housing of said turbine; low temperature heat is added to said housing in such a way evaporating said separated liquid on said housing; in such a way said liquid is fully vaporized, said vapor then enters a compressor, said compressor compresses said vapor to a higher condensation pressure and corresponding increased temperature, said vapor at said condensation pressure enters a condenser whereby heat is rejected and said vapor is fully condensed into state of saturated liquid, said saturated liquid enters said pump and repeats the cycle.

2. Heat pump apparatus as in claim 1 wherein said two-phase turbine powers said liquid pump and said vapor compressor.

3. Apparatus as in claim 1 or 2 wherein said working fluid in the form of a pressurized liquid is brought to its saturation state or into a two-phase state using heat obtained by combustion of a fuel or from some other heat source through said heat exchanger.

4. Apparatus as in claim 1 or 2 wherein said high pressure high temperature working fluid in the form of a saturated liquid flow or a two-phase flow enters rotor of said two-phase turbine where it expands as a two phase fluid to low pressure and temperature transforming most of its fluid energy into turbine shaft power of said two-phase flow turbine by performing work on a rotor of said two-phase flow turbines.

5. Apparatus as in claim 1 or 2 wherein said two-phase flow exiting from said turbine impinges tangentially onto walls of a stationary round housing whereon one phase of said two-phase flow separates as a vapor; a second phase of said two-phase flow in the form of a liquid impinging on said wall is fully evaporated by addition of heat of low temperature through said housing thereby achieving heat transfer to said working fluid as well as maintaining moderate temperatures of said housing of said two-phase turbine.

6. Apparatus as in claim 1 or 2 wherein said flow of said working fluid continues as a flow of dry vapor in said rotary vapor compressor which compresses said vapor to an intermediate pressure.

7. Apparatus as in claim 1 or 2 wherein said dry vapor is fully condensed by rejection of heat, from said working fluid in the form of said dry vapor to surroundings, occurring at an intermediate temperature through said heat exchange, thus accomplishing a heat pumping function of said heat pump system.

8. Apparatus as in claim 1 or 2 wherein said working fluid in the form of a condensed liquid is pumped to a high pressure by said liquid pump.

9. In combination with claim 1 an apparatus operating efficiently due to minimized losses due to having a thermal engine driving function and heat pumping engine function integrated into one compact system with full flow of said working fluid passing consecutively through all main components of said system.

10. In combination with claim 1 a thermally activated heat pump apparatus wherein heat pumping power and efficiency could be further increased by introducing two-phase flow or saturated dry vapor into said two-phase turbine rotor.

11. In combination with claim 1 a system which could increase its cooling or heat pumping power and efficiency by using interstage cooling for said compressor.

12. A heat pump cycle using a working fluid, comprising pumping through a pump the working fluid in a low temperature liquid state at condensation pressure to a higher pressure;

adding heat to the working fluid as a liquid at the pumped higher pressure to bring the working fluid to the proximity of a high temperature saturated liquid state;

flashing the working fluid from the proximity of the high temperature, saturated liquid state to a two-phase flow through a two-phase flow turbine;

adding low temperature heat to the two-phase flow of the working fluid from the two-phase flow turbine to fully vaporize the working fluid;

compressing in a compressor the working fluid vapor;

cooling the compressed working fluid vapor to a liquid;

returning the liquid to be pumped in repetition of the cycle.

13. The heat pump cycle of claim 12 further comprising driving the pump by the two-phase flow turbine.

14. The heat pump cycle of claim 13 further comprising driving the compressor by the two-phase flow turbine.

15. The heat pump cycle of claim 12 further comprising driving the compressor by the two-phase flow turbine.

16. The heat pump cycle of claim 12 further comprising collecting the liquid phase of the working fluid discharged from the two-phase flow turbine against a heating surface.

* * * * *